US005156756A

United States Patent [19]

Kojima et al.

[11] Patent Number: 5,156,756

[45] Date of Patent: Oct. 20, 1992

[54] LUBRICANT FOR AN ELECTRICAL SLIDING CONTACTOR

[75] Inventors: Takeshi Kojima; Sugako Otake, both of Aichi; Eigo Mukasa, Fujisawa; Kikuo Hosaki, Tokyo, all of Japan

[73] Assignee: Kabushiki Kaisha Tokai Rika Denki Seisakusho, Aichi, Japan

[21] Appl. No.: 689,627

[22] Filed: Apr. 23, 1991

[30] Foreign Application Priority Data

Apr. 23, 1990 [JP] Japan ..... 2-106719

[51] Int. Cl.[5] ..... C10M 125/10; C10M 141/10

[52] U.S. Cl. ..... 252/11; 252/25; 252/32.5

[58] Field of Search ..... 252/11, 25, 32.5

[56] References Cited

U.S. PATENT DOCUMENTS 3,775,317 11/1973 Inami et al. ..... 252/11

3,928,214 12/1975 Naka et al. ..... 252/25

4,177,316 12/1979 Diegelmann et al. ..... 252/11

4,256,489 3/1981 Van Wyle ..... 252/11

*Primary Examiner*—Jacqueline Howard

*Attorney, Agent, or Firm*—Birch, Stewart, Kolasch & Birch

[57] ABSTRACT

The present invention provides the lubricant for an electrical sliding contactor having excellent properties which comprises a synthetic wax or a grease composition comprising specific base oil and thickner and the defined amounts of specific additives, i.e. specific n-type semiconductor and/or the substance which changes into said semiconductor and alkylphosphoric acid surfactant. The lubricant according to the present invention can be applied effectively to an electrical sliding contactor for high current such as a slide contact of a sliding switch employed under more than 12 volts, sliding parts of trolley wire for an electric train and the like.

13 Claims, 4 Drawing Sheets

LUBRICANT FOR AN ELECTRICAL SLIDING CONTACTOR

TECHNICAL FIELD

The present invention relates to a lubricant for an electrical sliding contactor for high current of from several tens to hundreds of amperes which generates arc between the contact gap on switching operation (=switching arc), such as a sliding contact of a sliding switch employed under more than 12 volts power supply and sliding parts of trolley wire for an electric train, said lubricant, i.e. grease or wax, preventing effectively wear and erosion and combustive loss of said slide contact or sliding parts.

BACKGROUND ART

At the contact of these kinds of electrical sliding contactors, high-temperature switching arc is generated on switching operation or detaching and or chattering the trolley wire because said contact is switched under high current condition of more than 12 Volts (12 V is almost minimum voltage drawing of arc) and slided under the condition of high electric voltage and current. Under these conditions, harder copper alloys having high conductivity are employed as the contact. Small amounts of various kinds of metals are added to most copper alloys in order to increase their hardness and heat resistance. The metals having outer shells of electrons of $d^8$–$d^{10}$ such as Fe, Ni, Cu, Co, Zn, Ag and the like which are active for adsorption of hydrogen molecules at high temperature or alkaline earth metals whose oxides are active for adsorption of hydrogen molecules at a high temperature such as Mg, Ca, Cd, Zn and the like are added to the copper alloys.

When such an electrical sliding contactor consisting of these copper alloys is used, metallic powder is formed by wear of the contact and the electric arc is generated at the switching part or the detaching part of the trolly wire. Under these conditions of high temperature, metallic oxides powder formed by wear of the contact and metallic vapor of the contact bring about dehydrogenation of ingredients of the lubricant such as oil, wax and organic metallic soap applied on the surface of the contact, and cause decomposition and vaporization of, for example, polyether base oil or carbomixation of, for example, hydrocarbon base oil.

Copper oxides function as an oxidation catalyst for the base oils and the metallic soap at high temperature. For example, copper oxides accelerate oxidative deterioration of metallic salt of higher fatty acid such as lithium stearate and the Japanese like into varnishlike material. Therefore a lubricative grease which is the most general lubricant such as a grease comprising polyether base oil or hydrocarbon base oil and lithium stearate is not suited for the aforesaid use because the Japanese grease is exhausted during the use and wear of the contact is increased. A grease which comprises an inorganic filler such as bentonite as a substitute for metallic soap of higher fatty acid such as lithium stearate exhibits larger mechanical wear and poorer lubricant effect.

The aforementioned problems appear in a grease composition which is the subject matter of the former application by the present applicant (Japanese Patent Application No. 182397/1989). When the grease composition comprising a mixture of polyether and hydrocarbon base oils is used as a lubricative grease for a sliding switch having copper contact which makes and breaks at 14 V and 180 W, an insulating property of the switch is decreased because the grease is exhausted with a repetition of switching and the metallic powder formed by wear of the contact is adhered on the surface of an insulator in the vicinity of a breaking part of the contact whereat the electric arc is generated. In order to solve these problems, the present applicant has filed an application relating to improvement of wear-resistance of said grease composition when it is applied on the copper contact of the sliding switch (Japanese Patent Application No. 14453/1990), said grease composition being not suited for general usage.

The patent application No. 14453/1990 is based on the fact that, when the contact made of copper alloy in which small amounts of Sn are dispersed homogeneously is employed as a contact of the sliding switch, the grease composition disclosed in the patent Application No. 182397/1989 is not exhausted, wear of the switch is decreased, the metallic powder formed by wear of the switch is finer than that formed by wear of the switch comprising no tin and usability life of the switch is lengthened in spite of repetition of durability test of the switch. It has been found that the same effects as those mentioned above are obtained when a grease comprising α-olefin base oil and lithium stearate or a grease comprising polyol ester base oil and bentonite is employed in place of said grease composition disclosed in the patent application No. 182397/1989. It has also been found that more amounts of Sn are necessary to obtain the aforesaid effects when Fe is added to copper alloy. At the breaking part whereon arc heat is irradiated, oxides powder of Sn and Cu formed by wear of the contact or vapor thereof in the arc can function as an active catalyst. Based on an assumption that decomposition and deterioration of the grease which are caused by adsorption of hydrogen molecule as previously stated may be prevented effectively by $SnO_2$ (oxide powder of Sn) the present inventors have found that the aforesaid problems can be solved and expected effects are obtained by blending this compound with the grease composition homogeneously.

SUMMARY OF THE INVENTION

An object of the present invention is to provide a lubricant for an electrical sliding contactor whose composition is different from that of the grease disclosed in the patent Application No. 14453/1990, said lubricant being effective for preventing wear and combustive loss of an electrical sliding contactor for high current of from several tens to hundreds amperes which generates large switching arc on switching operation, such as a slide contact of a sliding switch employed under more than 12 volts power supply and sliding parts of trolley wire for an electric train.

The object can be achieved by a lubricant for an electrical sliding contactor which comprises 100 parts by weight of a synthetic wax or a grease composition compressing hydrocarbon oil and/or synthetic polyether oil and/or synthetic polyester oil as a base oil and metal salt of higher fatty acid as a thickner, 0.02–2 parts by weight of fine powder of metal oxide which is a specific n-type semiconductor and/or a substance which changes into said metal oxide at high temperature in the air calculated in terms of said metal oxide and 0.05–3 parts by weight of an alkylphosphoric acid surfactant.

DISCLOSURE OF THE INVENTION

Figure 1:
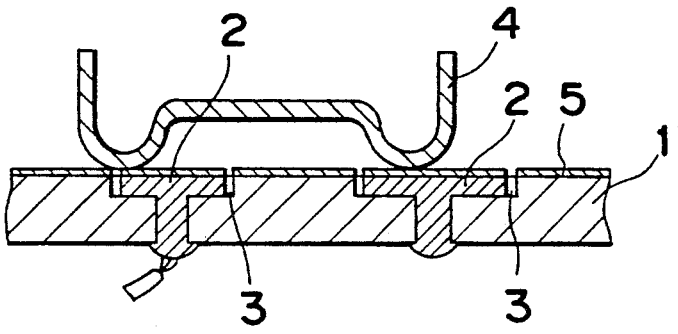
FIG. 1 is a schematic cross section of an embodiment of a sliding switch.

According to the present invention, a lubricant for an electrical sliding contactor is provided, said lubricant comprising 100 parts by weight of a synthetic wax or a grease composition which comprises hydrocarbon oil and/or synthetic polyether oil and/or synthetic polyester oil as a base oil and metal salt of higher fatty acid as a thickner, 0.02–2 parts by weight of fine powder of metal oxide which is a specific n-type semiconductor and/or a substance which changes into said metal oxide at high temperature in the air calculated in terms of said metal oxide and 0.05–3 parts by weight of an alkylphosphoric acid surfactant.

As a base oil of the grease composition employed in the present invention, synthetic polyether oils such as synthetic polyalkylene oil, synthetic diphenyl ether oil and the like, ester oils such as hindered ester of alcohol and fatty acid and the like and hydrocarbon oils such as synthetic $\alpha$-olefin oil, synthetic ethylene-$\alpha$-olefin oil, purified mineral oil and the like are exemplified.

As a metal salt of higher fatty acid, lithium stearate, lithium hydroxy stearate and lithium or calcium complex soap of stearic acid are exemplified.

As a preferred wax employed in the present invention, Fischer-Tropsch wax and/or polyethylene wax and the like which are used as a lubricant for trolley wire are exemplified.

As a suitable n-type semiconductor used in the present invention, $SnO_2$, mixture of $SnO_2$ and $TiO_2$ and the like are exemplified. Powdery compounds or metals which changes into the metallic oxide of n-type semiconductor at high temperature may be used.

Grain size of the aforesaid n-type conductor is usually less than 1 $\mu$, preferably less than 0.3 $\mu$.

The blending amount of the n-type semiconductor is 0.02–2 parts by weight in relation to 100 parts by weight of the grease composition or the synthetic wax. If the amount of the n-type semiconductor is below 0.02 part by weight, the expected object of the present invention cannot be achieved. When the amount of the n-type semiconductor is above 2 parts by weight, the grease becomes more viscous with an increase of frequency in use of the electrical sliding contactor and an excellent effect of the grease cannot be obtained.

As an alkylphosphoric acid surfactant employed in the present invention, "Sepearl 441-100" and "Sepearl B566" are exemplified, both surfactants being commercially available from Chukyo Yushi Inc., Japan.

The blending amount of said surfactant is 0.05–3 parts by weight, preferably 0.05–1 part by weight in relation to 100 parts by weight of the grease composition or the synthetic wax. If the amount of the surfactant is below 0.05 part by weight, sufficient effect of the surfactant cannot be obtained. When the amount of the surfactant is above 3 parts by weight, alkylphosphoric acid shows a tendency to corrode a copper plate in a corrosive atmosphere at high temperature.

In addition to aforesaid ingredients, conventional additives such as antioxidant and the like may suitably be added to the lubricant according to the present invention as the occasion may demand.

When the lubricant according to the present invention is applied on the sliding switch for high current, decomposition (exhaustion) and deterioration (carbonization) of the lubricant are prevented and life time of the electrical sliding contactor is long by the following two functions under the conditions of use that electric arc is generated at the time of switching high current.

The first function is to prevent local adhesion of fine conductive powder at a place where electric large arc generates. In the case of, for example, the sliding switch whereon an usual grease is applied, $Cu^{++}$plasma generated at the breaking part of the contact and fine powder of $Cu_2O$, $Ag_2O$ and the like which are p-type semiconductors formed by wear of the contact are adhered on a grease coated surface of the breaking part of the contact directly after the sliding of the contact and an insulator at nearly breaking parts of contact becomes conductible. Furthermore the grease are decomposed and exhausted and wear of the contact is accelerated at the breaking part of the contact which is heated remarkably by electric arc (cf. following comparative example 2).

When the lubricant according to the present invention is employed, these problems do not occur. As shown in, for example, the following example 2, not only exhaustion of the grease but also adhesion of metallic powder formed by wear of the contact are not brought about. The reason why these effects are obtained is that a conductive film is formed on the breaking part of the contact and insulator by adhesion of the grease and decomposition and vaporization of the grease are prevented because $Cu^{++}$and p-type semiconductor such as $Cu_2O$ which are electron deficient fine particles are dispersed in the grease, said fine particles being adsorbed by electron rich n-type semiconductor such as $SnO_2$ dispersed homogeneously in the grease by alkylphosphoric acid surfactant.

The second function is to catalyze an oxidation of soot formed by carbonization of the base oil, wax and the like into $CO_2$. When a former grease or wax is employed, base oil such as hydrocarbon oil or wax and the like are carbonized to soot by arc heat and said soot adheres to the insulator, particularly a region thereof near the breaking part of the contact to bring about an insulation deterioration of the sliding switch (cf. the following comparative example 1). However, when the lubricant according to the present invention is employed, the insulation deterioration caused by adhesion of carbonized products of base oil, wax and the like can effectively be prevented because said carbonized products are oxidized to $CO_2$ by the action of $SnO_2$ and the like. For example, the insulating deterioration in the following comparative example 1 is decreased to about one fifth by adding 0.3 percent by weight of $SnO_2$ into the lubricant (cf. the following example 1).

The present invention is illustrated by the following examples.

EXAMPLES

Examples 1-3

Lubricants 1-3 for a sliding switch were prepared in conformity with the blending prescriptions described in Table 1.

Figure 2:
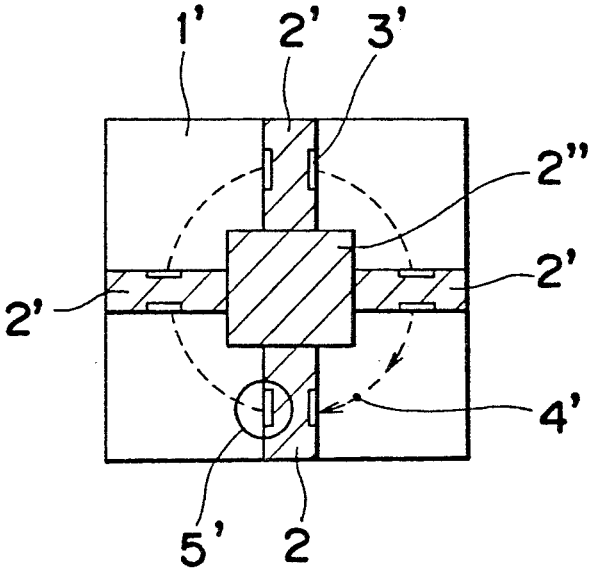
FIG. 2 is a schematic plan of the test sample for a sliding switch.

The sliding switch for test as shown in FIG. 2 which is a schematic plan of the sliding switch was constructed. In FIG. 2, (1'), and (3') indicate an insulator made of polyamide 66 with which glass fiber is blended, (2', 2'') indicate a fixed contact and (4') indicate moving contact which is a tough pitch copper plate and air gap (0.50 mm) respectively and (5') indicate breaking part when moving contact is moved an arrow.

Figure 3:
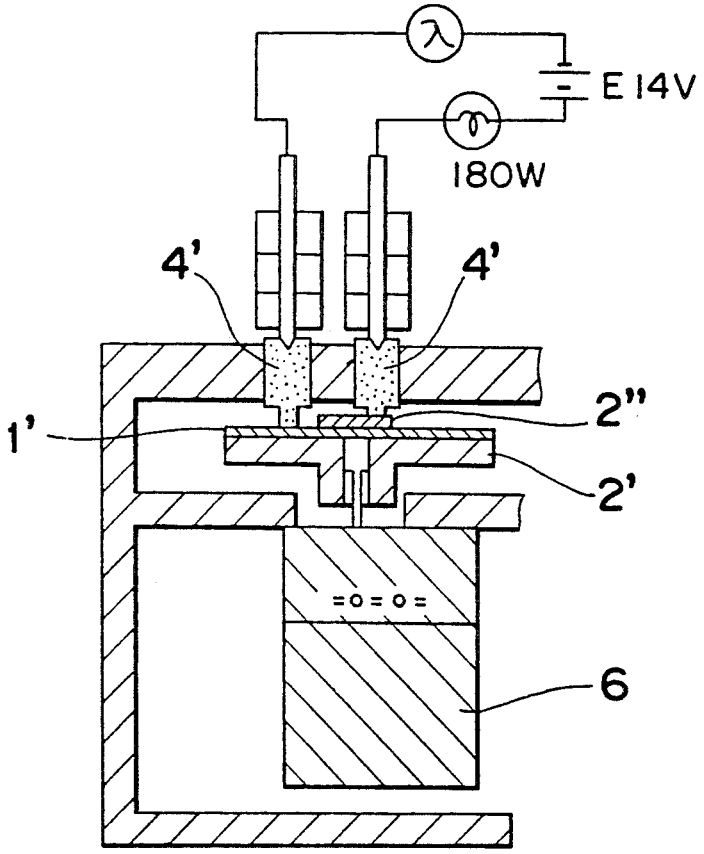
FIG. 3 is a schematic cross section of the apparatus for testing durability of the sliding switch.

The sliding switch was fixed to the apparatus for testing durability of the switch as shown in FIG. 3 which is a schematic cross section of said apparatus. The lublicant 1, 2 or 3 was coated on a sliding surface of the switch. Relation between insulation resistance and rotational switching frequency of the sliding switch was measured by conducting the switching test 50,000 times under the constant load (DC 14 V;180 W lamp). The results obtained are shown in Table 1 and FIGS. 4-6. Insulation resistance was measured at the place between the fixed contact and at the point which is 3 mm away from the breaking point shown in FIG. 2 by means of 500 V megger.

The symbols of (1'), (2'), (2'') and (4') used in FIG. 3 have the same meanings as that used in FIG. 2 and (6) indicates a motor.

COMPARATIVE EXAMPLES 1-3

Lubricants 1'-3' were prepared in conformity with the blending prescriptions described in Table 1.

According to the procedures described in examples 1-3, the lubricant 1', 2' or 3' was coated on the sliding surface of the switch and durability of the switch was measured. The results obtained are shown in Table 1 and FIG. 7-9.

When the lubricant according to the present invention is applied to a part to which an electric current is sent, a chattering part and a switching part of a contact of an electrical sliding contactor which generates an electric arc, said lubricant is hard to exhaust and deteriorate. If the lubricant according to the present invention is applied to the electrical sliding contactor to which voltage of more than minimum arc voltage (about 12 V for copper) is applied, such as a sliding switch for high current of a car and sliding parts of trolley wire for an electric train, problems pertaining to wear of the contactors caused by deterioration of a former lubricant can be solved. Therefore, the lubricant according to the present invention can meet the needs for lengthening a life, increasing a reliability and miniaturizing a size of the contactors.

TABLE 1

Figure 4:
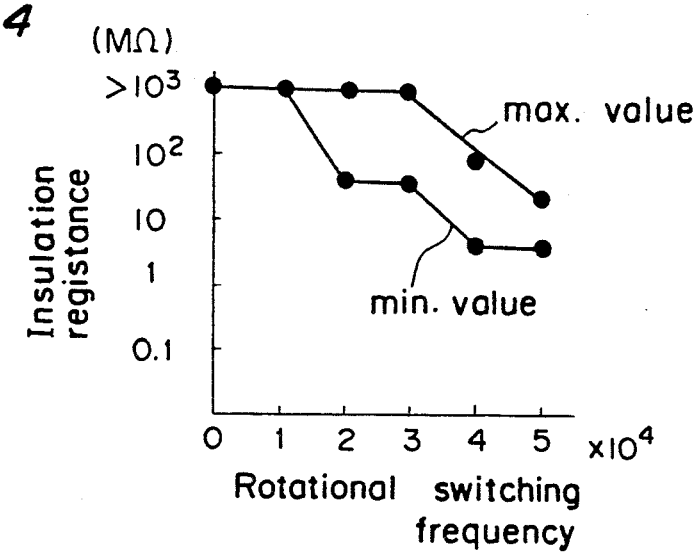
FIG. 4–9 are the graphs showing relation between insulation resistance and rotational switching frequency of the sliding switches prepared in the examples and comparative examples.
Figure 5:
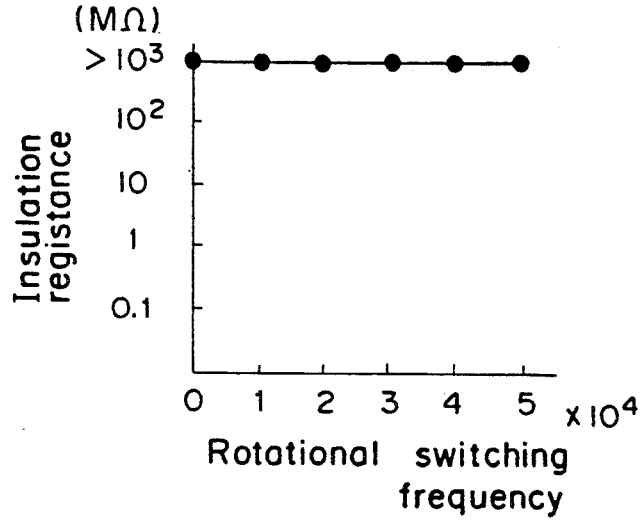
Figure 6:
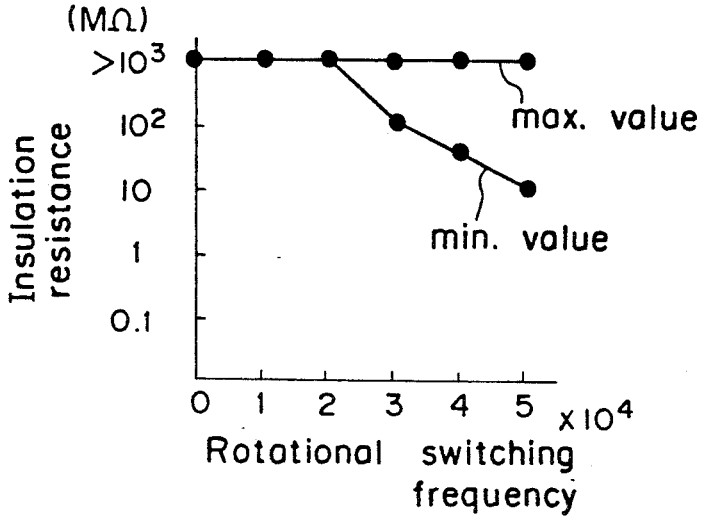
Figure 7:
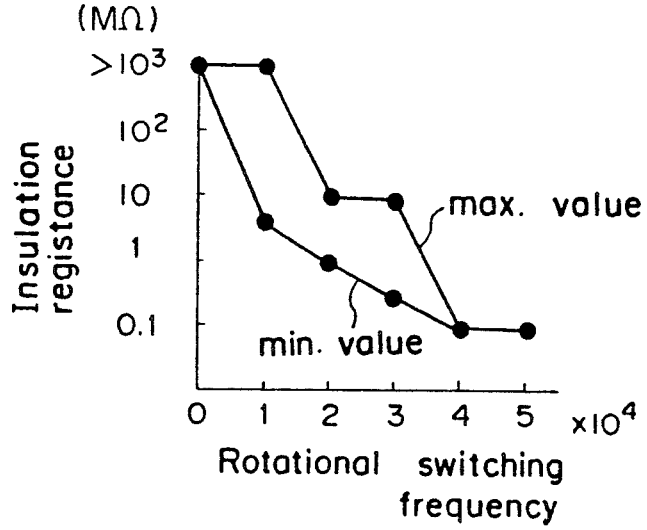
Figure 8:
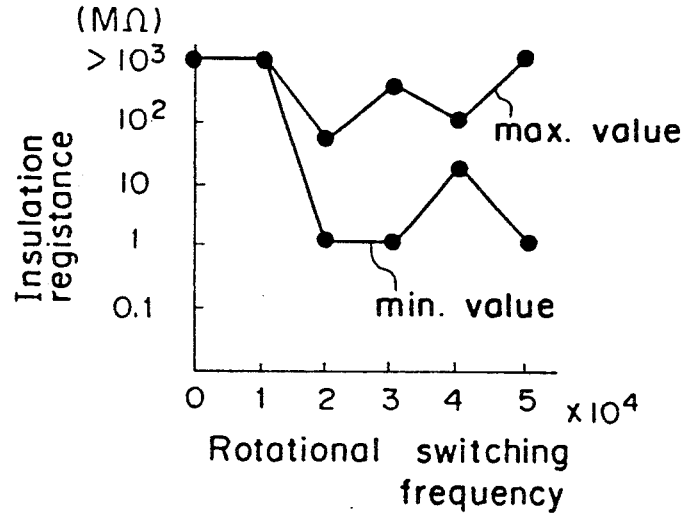
Figure 9:
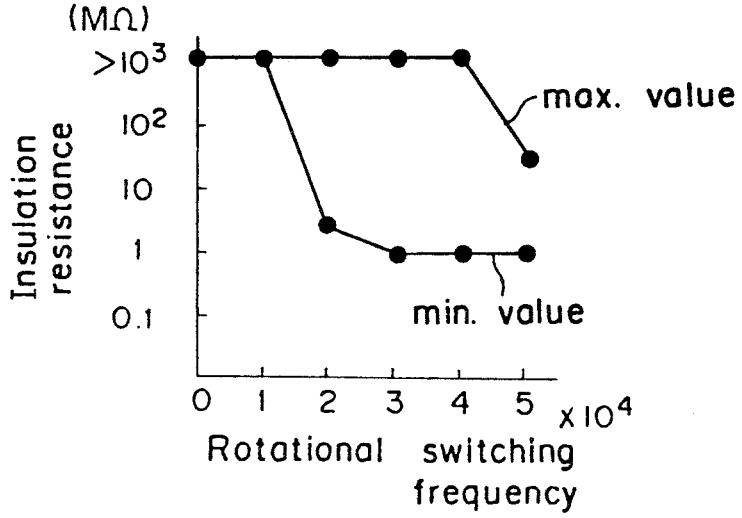

| | | examples | | | comparative examples | | |
|---|---|---|---|---|---|---|---|
| | lubricant | 1 | 2 | 3 | 1' | 2' | 3' |
| ingredients of the lubricant (part by weight) | synthetic α-olefin oil (1) | 79.5 | 0 | 0 | 80.0 | 0 | 0 |
| | polyoxypropylene glycol monoether (2) | 0 | 79.5 | 0 | 0 | 80.0 | 0 |
| | polyol complex ester (3) | 0 | 0 | 84.3 | 0 | 0 | 84.8 |
| | lithium stearate | 18.9 | 18.9 | 14.6 | 19.0 | 19.0 | 14.7 |
| | alkylphosphoric acid surfactant (4) | 0.3 | 0.3 | 0.3 | 0 | 0 | 0 |
| | $SnO_2$ ultrafine particle (5) | 0.3 | 0.3 | 0.3 | 0 | 0 | 0 |
| | antioxydant (6) | 1.0 | 1.0 | 0.5 | 1.0 | 1.0 | 0.5 |
| sliding switch for test | | the switch shown in FIG. 2 | | | | | |
| durability of the sliding | states of the lubricant applied to the contact during and after 50,000 cycles durability test (7) | B | A | C | D | E | F |
| | wear of the movable contact (15 mg) after 50,000 cycles-durability test (mg) | 2 | 1.5 | 1.5 | 4 | 6 | 5 |
| | insulation deterioration (8) | B | A | C | D | E | F |
| | | FIG. 4 | FIG. 5 | FIG. 6 | FIG. 7 | FIG. 8 | FIG. 9 |

(1) The mixture of "Lipolube" (viscosity: 49 cst/40° C.) which is commercially available from Lion Inc., Japan.
(2) "New Pole LB 285" which is commercially available from Sanyo Kasei Inc., Japan.
(3) "Unistar C3371" which is commercially available from Nihon Yushi Inc., Japan.
(4) "Sepearl B566" which is commercially available from Chukyo Yushi Inc., Japan.
(5) Conductive ultrafine powder "T-1" which is commercially available from Mitsubishi Kinzoku Inc., Japan
(6) Mixture of benzotriazol and phenolic antioxidant was used in case of the lubricants 1, 2, 1' and 2'. In case of the lubricants 3 and 3', a mixture of diphenylamine and benzotriazol was employed.
(7) A: Viscosity increase and weight loss of the lubricant was scarcely observed in spite of the coloring thereof.
B C: Carbonization, viscosity increase and weight loss of the lubricant were slightly observed with the coloring thereof.
D = F: Not only much carbonization of the lubricant but also remarkable viscosity increase and weight loss were observed.
E: After about 30,000 cycle of the switching, the lubricant was begun to exhaust and wear of the contact was increased.
(8) A: Adhesion of copper powder formed by wear of the contact to the insulating part of the switch and accumulation of the carbonized products of the lubricant were not observed. Insulation resistance was more than 1000 MΩ.
B = C: Although adhesion of copper powder formed by wear of the contact to the insulating part of the switch was not observed, the carbonized products of the lubricant were accumulated. Insulation resistance was more than 1 MΩ.
D: Not only remarkable adhesion of copper powder formed by wear of the contact to the insulating part of the switch but also remarkable accumulation of the carbonized products of the lubricant were observed. Minimum insulation resistance was 0.1 MΩ.
E: Exhausion of the lubricant and scattering and adhesion of copper powder were observed. Minimum insulation resistance after about 30,000 cycle of the switching was 1 MΩ.
F: Remarkable adhesion of copper powder and carbonized products was observed. Minimum insulation resistance was 1.0 KΩ.

What is claimed is:

1. A lubricant for an electrical sliding contactor which comprises 100 parts by weight of a synthetic wax or a grease composition comprising hydrocarbon oil and/or synthetic polyether oil and/or synthetic polyester oil as a base oil and metal salt of higher fatty acid as a thickner, 0.02-2 parts by weight of fine powder of metal oxide which is a specific n-type semiconductor and/or a substance which changes into said metal oxide at high temperature in the air calculated in terms of said metal oxide and 0.05-3 parts by weight of an alkylphosphoric acid surfactant.

2. The lubricant according to claim 1, in which the specific n-type semiconductor is $SnO_2$ and/or $TiO_2$ whose grain size is less than 1 μ.

3. The lubricant according to claim 1, wherein said base oil is selected from the group consisting of synthetic polyalkylene oil, synthetic diphenyl ether oil, synthetic-alpha-olefin oil and purified mineral oil.

4. The lubricant according to claim 1, wherein said lubricant comprises 100 parts by weight of a grease composition comprising a base oil which is a synthetic alpha-olefin oil.

5. The lubricant according to claim 1, wherein said lubricant comprises 100 parts by weight of a grease composition comprising a base oil which is a polyoxypropylene glycol monoether.

6. The lubricant according to claim 1, wherein said lubricant comprises 100 parts by weight of a grease composition comprising a base oil which is a polyol complex ester.

7. The lubricant according to claim 1, wherein said metal salt of a higher fatty acid is selected from the group consisting of lithium stearate, lithium hydroxy stearate, lithium complex soap of stearic acid and calcium complex soap of stearic acid.

8. The lubricant according to claim 1, wherein said metal salt of a higher fatty acid is lithium stearate.

9. The lubricant according to claim 1, wherein said lubricant comprises 100 parts by weight of a synthetic wax comprising polyethylene wax.

10. The lubricant according to claim 1, wherein said metal oxide is a specific n-type semiconductor selected from the group consisting of $SnO_2$, $TiO_2$, and wherein the grain size thereof is less than 1 micron.

11. The lubricant according to claim 1, wherein said metal oxide is a specific n-type semiconductor which is $SnO_2$.

12. The lubricant according to claim 10, wherein said grain size is less than 0.3 microns.

13. The lubricant according to claim 1, wherein said surfactant is present in an amount of 0.05-1 part by weight.

* * * * *